United States Patent [19]

Wakisaka et al.

[11] Patent Number: 4,629,174

[45] Date of Patent: Dec. 16, 1986

[54] PAPER SHEET COLLECTING APPARATUS

[75] Inventors: Yukinori Wakisaka, Kawagoe; Toshiyuki Miyano, Yokohama, both of Japan

[73] Assignee: Kabushiki Kaisha Toshiba, Kawasaki, Japan

[21] Appl. No.: 615,906

[22] Filed: May 31, 1984

[30] Foreign Application Priority Data

May 31, 1983 [JP] Japan ..... 58-96149

[51] Int. Cl.[4] ..... B65H 29/40; B65H 31/32

[52] U.S. Cl. ..... 271/186; 271/187; 271/315; 271/218

[58] Field of Search ..... 271/315, 186, 187, 189, 271/308, 312, 313, 314, 218, 217

[56] References Cited

U.S. PATENT DOCUMENTS 4,470,590 9/1984 Ariga et al. ..... 271/187

4,501,418 2/1985 Ariga et al. ..... 271/187

FOREIGN PATENT DOCUMENTS 0102814 3/1984 European Pat. Off. ..... 271/186

*Primary Examiner*—Bruce H. Stoner, Jr.

*Assistant Examiner*—Lawrence J. Goffney, Jr.

*Attorney, Agent, or Firm*—Cushman, Darby & Cushman

[57] ABSTRACT

In a paper sheet collecting apparatus according to the present invention, paper sheets successively fed from a conveying path are guided and collected into a collecting chamber, held between vanes of a rotating vane wheel, is provided with a separator which can rock around the rotating shaft of the vane wheel and also move in the radial direction of the rotating shaft. In distributing the paper sheets, the separator is rocked through a predetermined angle and then moved radially, so that succeeding paper sheets guided by the vane wheel are temporarily and assortatively collected on the separator.

8 Claims, 8 Drawing Figures

PAPER SHEET COLLECTING APPARATUS

BACKGROUND OF THE INVENTION

The present invention relates to a paper sheet collecting apparatus for collecting paper sheets one by one into a collecting chamber and, more specifically, to an improvement of a paper sheet collecting apparatus in which paper sheets successively fed from a conveying path are guided and collected into a collecting chamber held between vanes of a rotating vane wheel.

In conventional bank note rearrangers, for example, bank notes fed collectively are taken out one by one. After the takeout, the bank notes are discriminated and classified into reusable notes (correct notes) and non-reusable notes (damaged notes), and are assortatively collected in accordance with the results of the discrimination. The collected bank notes are half-wrapped in blocks of one hundred.

Usually, in the bank note rearrangers of this type, bank notes fed to a supply unit are successively taken out and transferred along a conveying path in a manner such that the longitudinal axes of the bank notes are at right angles to the transfer direction. The transferred notes are passed through a correct/damaged discrimination unit, and then classified by a correct/damaged classification unit. Then, the correct and damaged bank notes are successively collected and piled into their corresponding collecting chambers.

In the apparatus constructed so that bank notes are fed directly from the conveying path into the collecting chambers, however, if the bank notes are transferred successively and at a relatively high speed, a following bank note will be fed before a preceding bank note is entirely collected. Accordingly, the forward end of the following bank note will often run against the rear end of the foregoing bank note, disordering or preventing the collecting operation.

Recently, therefore, a collecting apparatus has been developed for practical use in which paper sheets or bank notes P, fed from a conveying path 10 formed of a conveyor belt, are temporarily held between adjacent pairs of vanes 14 of a vane wheel 12, and are then guided into a collecting chamber 16 as the vane wheel 12 rotates, as shown in FIG. 1. According to this prior art collecting apparatus, the bank notes P successively fed at high speed from the conveying path 10 can be collected into the collecting chamber 16 in an orderly manner. This apparatus is also provided with a separator 18 which can rock around the rotating shaft of the vane wheel 12. The separator 18 is rocked from a position A (indicated by a solid line) through a position B (indicated by a broken line) to a position C (indicated by two-dot chain line) when a predetermined number of bank notes P, e.g., 100 sheets, have been guided into the collecting chamber 16. In the position C, the following bank notes P are temporarily collected on a receiving portion 20 of the separator 18. Thus, the conventional collecting apparatus can perform continuous processing without suspending the collecting operation.

In the prior art collecting apparatus of this vane-wheel type, however, the receiving portion 20 of the separator 18 needs to be relatively long for satisfactory collection. Therefore, the following bank notes P cannot be fed before the receiving portion 20 entirely passes through a bank note discharge section of the conveying path 10. Thus, the transfer pitch for the bank notes P cannot be narrowed, constituting a great hindrance to the improvement of the speed of bank note collection. Moreover, the forward ends of the bank notes P fed from the conveying path 10 would run against and rebound upon the end face of an arm portion 22 of the separator 18 to disturb the collection of the bank notes P.

SUMMARY OF THE INVENTION

The present invention is contrived in consideration of these circumstances, and is intended to provide a paper sheet collecting apparatus capable of high-speed collection of paper sheets, in which paper sheets successively fed at short pitches can be assortatively collected in regular blocks in an orderly manner.

In order to attain the above object, a paper sheet collecting apparatus according to the invention, in which paper sheets successively fed from a conveying path are guided and collected into a collecting chamber held between vanes of a rotating vane wheel, is provided with a separator which can rock around the rotating shaft of the vane wheel and also move in the radial direction of the rotating shaft. In distributing the paper sheets, the separator is rocked through a predetermined angle and then moved radially, so that succeeding paper sheets guided by the vane wheel are temporarily and assortatively collected on the separator.

Specifically, according to one aspect of the present invention, there is provided a paper sheet collecting apparatus for collecting paper sheets successively fed from a conveying path into a collecting chamber, comprising a vane wheel rotatably disposed between the outlet of the conveying path and the inlet of the collecting chamber, said vane wheel including a drum-shaped frame and a plurality of vanes arranged on the outer peripheral surface of the frame along the circumference thereof; first driving means for rotating the vane wheel on a fixed axis of rotation, whereby the vane wheel holds each of the paper sheets from the conveying path between each two adjacent vanes thereof so that the paper sheets are guided into the collecting chamber as the vane wheel rotates; separator means rotatable on the same axis of rotation of the vane wheel and movable in the radial direction of the vane wheel frame; and second driving means adapted to hold the separator means in a radially inward position off the outlet of the conveying path at the time of collection of the paper sheets and, to rock the separator means through a predetermined angle, thereby causing the separator means to pass by the outlet of the conveying path, and then to move the separator means radially outward so that the paper sheets can be collected on the separator means at the time of distribution of the paper sheets, whereby the paper sheets are guided and collected into the collecting chamber by the vane wheel at the time of collection of the paper sheets, and the paper sheets fed from the conveying path are temporarily collected on the separator means by the vane wheel after the separator means passes by the outlet of the conveying path at the time of distribution of the paper sheets.

BRIEF DESCRIPTION OF THE DRAWINGS

FIGS. 2 to 8 show one embodiment of a paper sheet collecting apparatus according to the present invention, in which:

FIG. 2 is a front view schematically showing the collecting apparatus;

FIG. 3 is a partial plan view showing the collecting apparatus;

FIG. 4 is a sectional view showing the principal part of the collecting apparatus;

FIG. 5 is a sectional view of the collecting apparatus taken along line V—V of FIG. 3;

FIG. 6 is a front view illustrating the loci of movement of a cam follower and a separator relative to a cam;

FIG. 7 is a plan view showing a moving speed regulating mechanism; and

FIG. 8 is a perspective view schematically showing the collecting apparatus.

DETAILED DESCRIPTION OF THE PREFERRED EMBODIMENT

One embodiment of a paper sheet collecting apparatus according to the present invention will now be described in detail with reference to the accompanying drawings of FIGS. 2 to 8.

Figure 1:
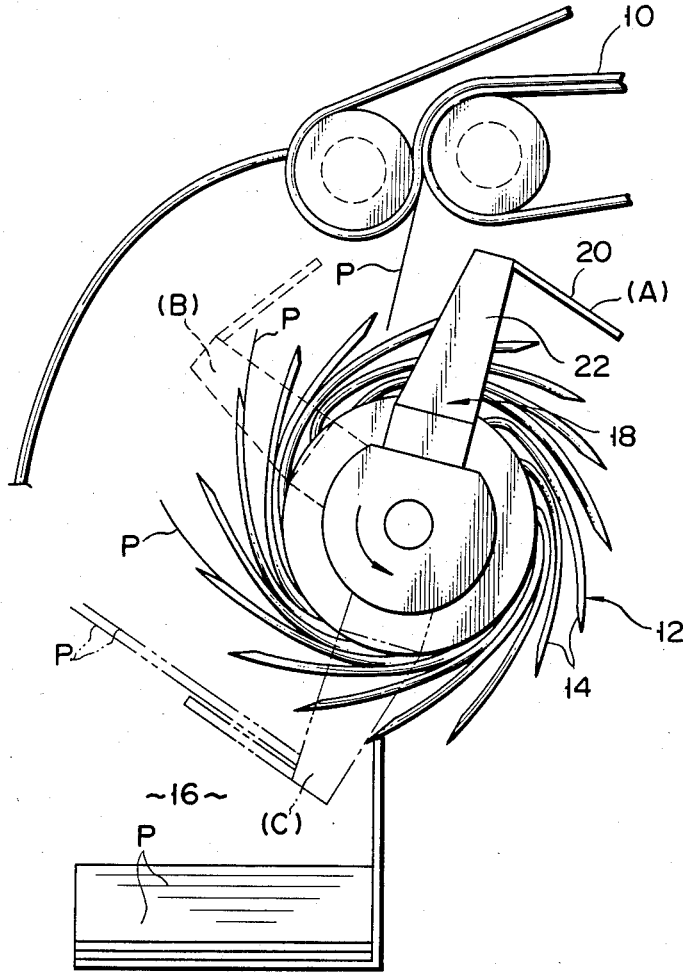
FIG. 1 (PRIOR ART)
FIG. 1 is a front view schematically showing a prior art collecting apparatus.
Figure 2:
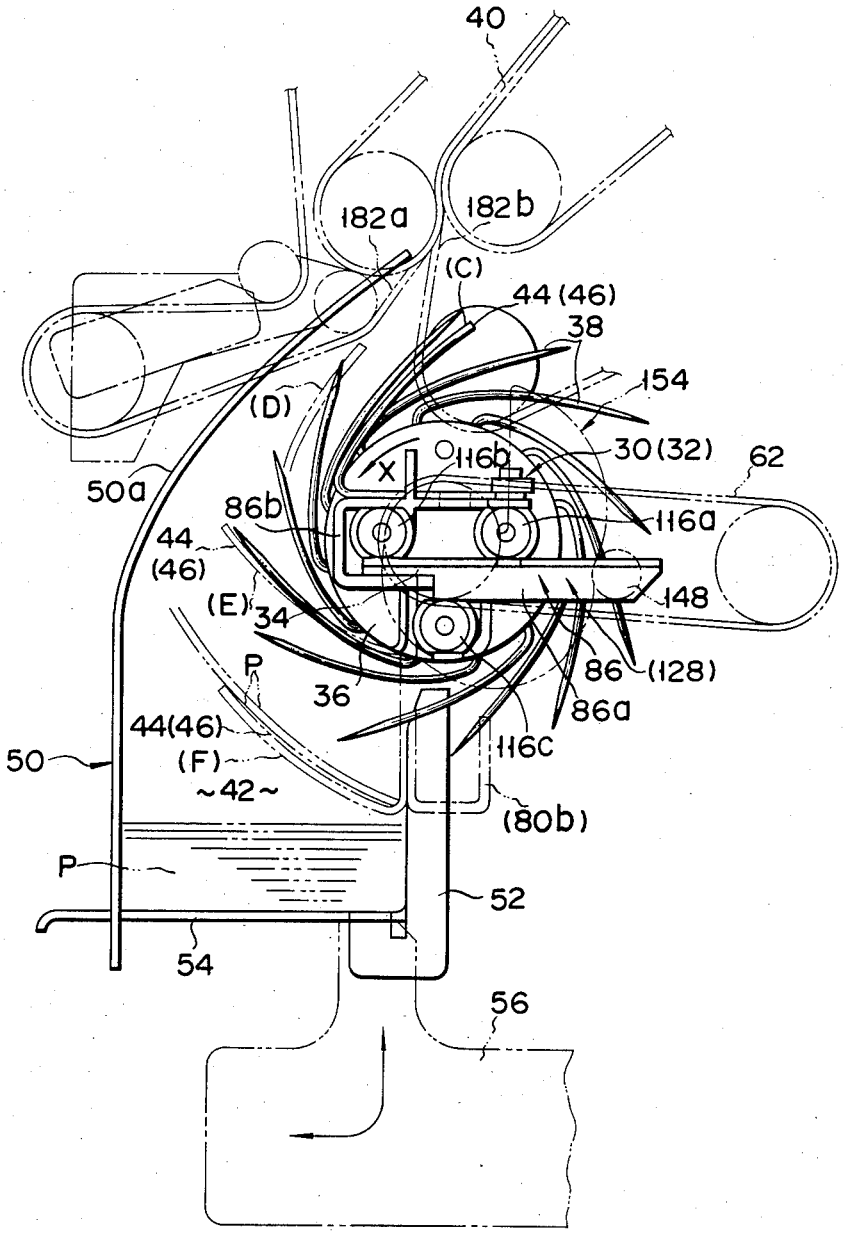

In FIG. 2, numerals 30 and 32 designate vane wheels. The vane wheels 30 and 32 each comprise a ring-shaped frame 36 fixed to a sleeve 34 as a rotating shaft and a plurality of vanes 38 attached to the outer periphery of the frame 36 along the circumference thereof. The base end portions of the vanes 38 protrude radially from the peripheral surface of the ring-shaped frame 36. The distal end portions of the vanes 38 are bent in the direction opposite to the rotating direction of the vane wheels 30 and 32. The space between each two adjacent vanes 38 is tapered toward the base portion. Thus, the vanes 38 form a voluted configuration. Paper sheets P, such as bank notes, successively fed from a conveying path 40 are held between the adjoining pairs of vanes 38, and are guided and collected one after another into a collecting chamber 42 as the vane wheels 30 and 32 rotate.

Separators 44 and 46, which adjoin the vane wheels 30 and 32, respectively, can rotate on the same axis of rotation of the sleeve 34 and can also move in the radial direction of the sleeve 34. The separators 44 and 46 are rocked through a predetermined angle and then moved radially by a separator operating mechanism 48 (mentioned later) when, for example, 100 paper sheets P are collected in the collecting chamber 42 during paper sheet distribution. Thus, the separators 44 and 46 can temporarily collect a succeeding group of paper sheets P guided by the vane wheels 30 and 32 into the collecting chamber 42 in a manner such that they are separated from a preceding group of paper sheets P collected in the collecting chamber 42.

The separators 44 and 46 have substantially the same shape as the individual vanes 38 of the vane wheels 30 and 32. The extending direction of the separators 44 and 46, like that of the vanes 38 of the vane wheels 30 and 32, is opposite to the rotating direction of the vane wheels 30 and 32.

The collecting chamber 42 is defined between a first guide 50 having a curved portion 50*a* on the upper end side extending along the periphery of the vane wheels 30 and 32 and a second guide 52 substantially opposed in parallel to the lower end portion of the first guide 50. The second guide 52 is provided with a cut portion (not shown) through which the vane wheels 30 and 32 and the separators 44 and 46 can pass.

The second guide 52 is attached to a movable block 56 so that the guide 52 is integral with a receiving plate 54 which constitutes the bottom of the collecting chamber 42. The paper sheets P collected in the collecting chamber 42 are delivered to a discharge mechanism (not shown) as the movable block 56 moves.

Figure 3:
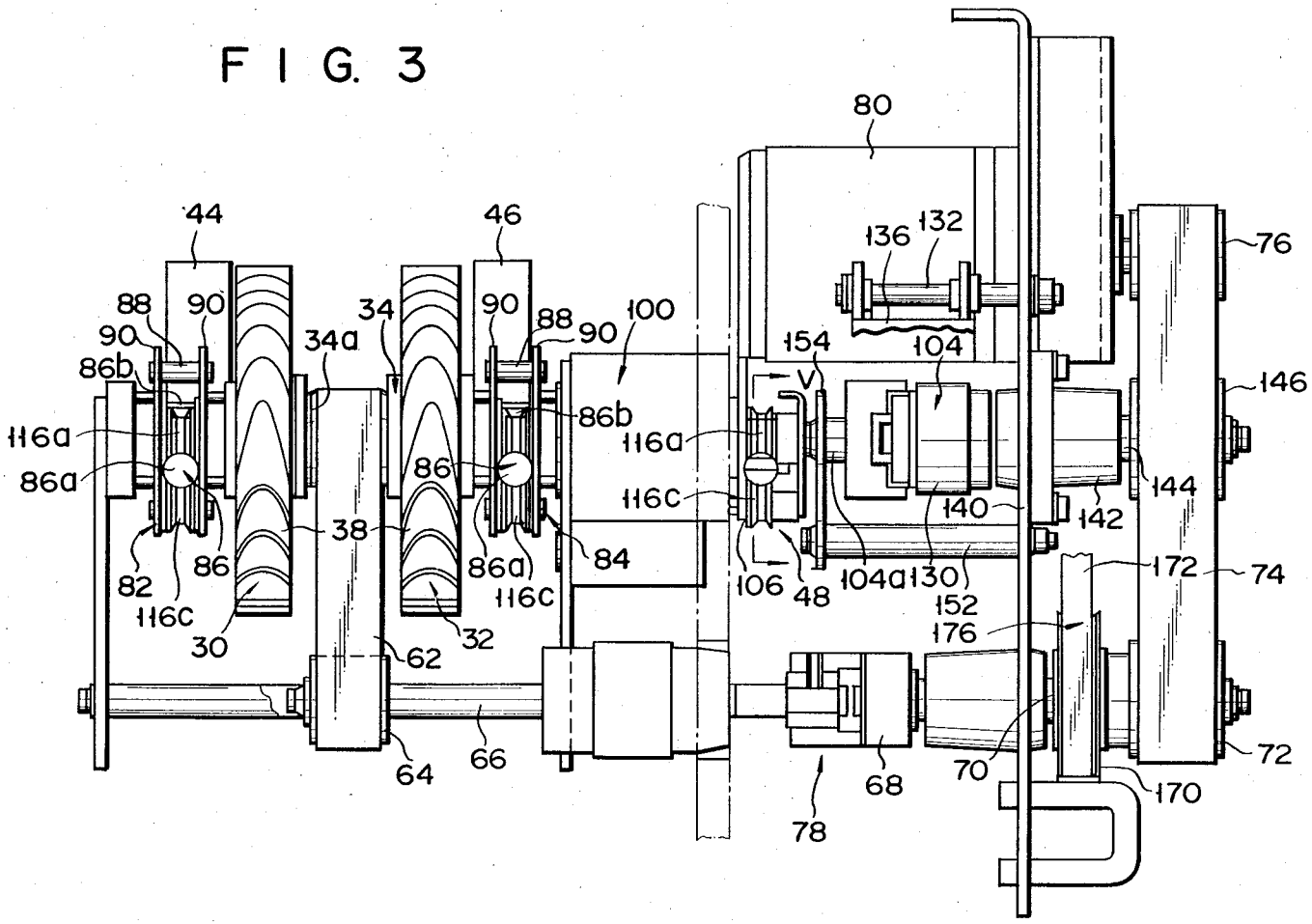
Figure 4:
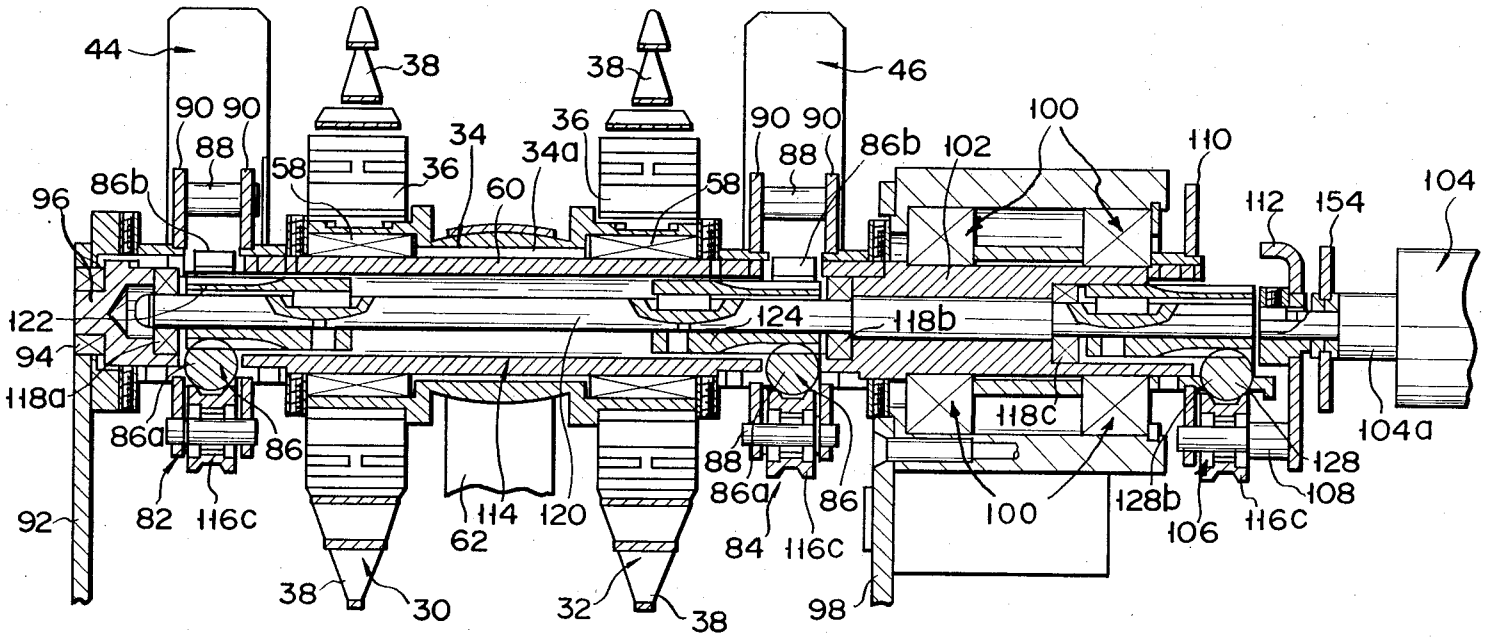

As shown in FIGS. 3 and 4, the vane wheels 30 and 32 are attached individually to both end portions of the sleeve 34 as a rotating shaft, which is rotatably fitted on a hollow shaft 60 by means of a pair of bearings 58 (see FIG. 4). Thus, the two vane wheels 30 and 32 can rotate together. A pulley portion 34*a* is formed at the middle portion of the sleeve 34. The pulley portion 34*a* is given the driving force of a motor 80, transmitted through a power transmission system 78 which includes a belt 62, pulley 64, shaft 66, coupling 68, shaft 70, pulley 72, belt 74, and pulley 76, as shown in FIG. 3. In the state shown in FIG. 2, the vane wheels 30 and 32 are rotated counterclockwise (in the direction of arrow X) at a peripheral speed half the paper sheet transfer speed of the conveying path 40.

The separators 44 and 46 are attached individually to moving members 86 each of which is fitted to and can reciprocate relative to first and second rotating bodies 82 and 84, respectively, rotating on the same axis with the sleeve 34 as the rotating shaft of the vane wheels 30 and 32. As shown in FIGS. 3 and 4, each of the first and second rotating bodies 82 and 84 is formed of two disks 90 coupled by means of a plurality of coupling pins 88. The two rotating bodies 82 and 84 individually adjoin both end portions of the hollow shaft 60. One frame 92 constituting the housing of the collecting apparatus is fitted with a bearing 94. A first bored support shaft 96 supported by the bearing 94 is coupled to the first rotating body 82. The other frame 98 constituting the housing of the collecting apparatus is fitted with a second bearing 100. One end of a second bored support shaft 102 supported by the bearing 100 is coupled to the second rotating body 84.

The other end of the second bored support shaft 102 is connected to a third rotating body 106 which is coupled to an output shaft 104*a* of a clutch mechanism 104. Like the first and second rotating bodies 82 and 84, the third rotating body 106 is formed of two disks 110 and 112 coupled by means of a plurality of coupling pins 108. By connecting and disconnecting the clutch mechanism 104, a rotary unit 114 consisting of the third rotating body 106, second bored support shaft 102, second rotating body 84, hollow shaft 60, first rotating body 82, and first bored support shaft 96 can be intermittently and integrally rotated on the same axis with the sleeve 34.

Three guide rollers 116*a*, 116*b* and 116*c* are rotatably arranged between the paired disks 90 of each of the first and second rotating bodies 82 and 84. The moving members 86 fitted with the separators 44 and 46 are held by the guide rollers 116*a*, 116*b* and 116*c* so that they can reciprocate relative to the first and second rotating bodies 82 and 84. The moving members 86 each include a rack 86*a* and an L-shaped guide arm 86*b* coupled thereto. As shown in FIG. 4, the racks 86*a* of the two moving members 122, 86 are in mesh with first and second pinions 122 and 124 fitted on a pinion mounting shaft 120, which extends along the axis of the rotary unit 114 and is rotatably supported by bearings 118*a*, 118*b* and 118*c*.

Figure 5:
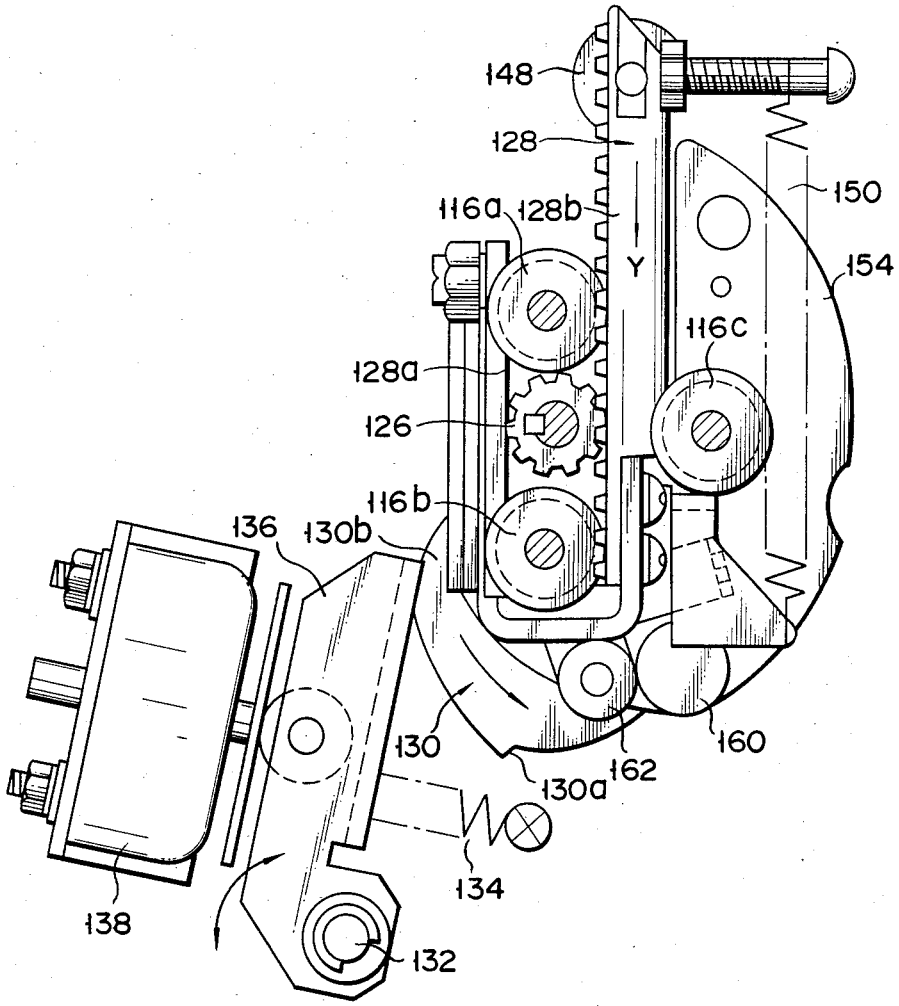

A third pinion 126 is fitted on that portion of the pinion mounting shaft 120 which corresponds to the third rotating body 106. As shown in FIGS. 4 and 5, a moving member 128 similar to the moving members 86 is held by three guide rollers 116*a*, 116*b* and 116 so that they can reciprocate relative to the third rotating body 106. The moving member 128 is formed of an L-shaped guide arm 128*a* and a rack 128*b*. The third pinion 126 is in mesh with the rack 128*b*.

When the moving member 128 connected to the third rotating body 106 reciprocates, the moving members 86 attached to the first and second rotating bodies 82 and 84 reciprocate simultaneously. Thus, the separators 84 and 86 move together in the radial direction of the vane wheels 30 and 32.

As shown in FIG. 5, the clutch mechanism 104 for connecting and disconnecting the driving force to the rotary unit 114 is formed of a two-position spring clutch, which includes a sleeve 130 with first and second retaining portions 130*a* and 130*b* in positions with a phase difference of 90°. The distal end of a stopper 136 is pressed against the peripheral surface of the sleeve 130. The stopper 136 is always urged clockwise by a spring 134, and can rock around a shaft 132. Also, the stopper 136 is shifted counterclockwise against the urging force of the spring 134 by an electromagnet 138. When the distal end of the stopper 136 is disengaged from the first retaining portion 130*a* of the sleeve 130, the spring clutch 104 is connected. When the distal end of the stopper 136 engages the second retaining portion 130*b*, the spring clutch 104 is disconnected. Thus, the rotary unit 114 rocks through 90° while the distal end of the stopper 136 moves from the first retaining portion 130*a* to the second retaining portion 130*b*. When the distal end of the stopper 136 is disengaged from the second retaining portion 130*b* of the sleeve 130 as the electromagnet 138 is energized after the 90-degree rocking, the rotary unit 114 rocks through 270° before the distal end of the stopper 136 engages the first retaining portion 130*a* again.

Thus, as the electromagnet 138 is connected and disconnected, the moving members 86 and 128 attached to the rotating bodies 82, 84 and 106 forming part of the rotary unit 114 rock from a horizontal or stand-by position (indicated by a full line in FIG. 2) to a vertical position (indicated by a two-dot chain line in FIG. 2), and return to the horizontal position.

An input shaft (not ) of the clutch mechanism 104 is coupled to a rotating shaft 144 which is rotatably supported by a bearing 142 attached to a frame 140, as shown in 3. The driving force of the belt 74, driven b motor 80, is transmitted to the rotating shaft 144 a pulley 146 fitted on one end of the shaft 144

As shown in FIG. 5 a follower 148 is mounted on one end side of the rack 128*b* of the moving member 128 attached to the third rotating body 106. The cam follower 148 is always urged in a certain direction (indicated by arrow Y) by a spring 150. Thus, the cam follower 148 is always in rolling contact with the guide surface of a cam 154, which is mounted on the frame 140 by means of a pair of support rods 152.

Figure 6:
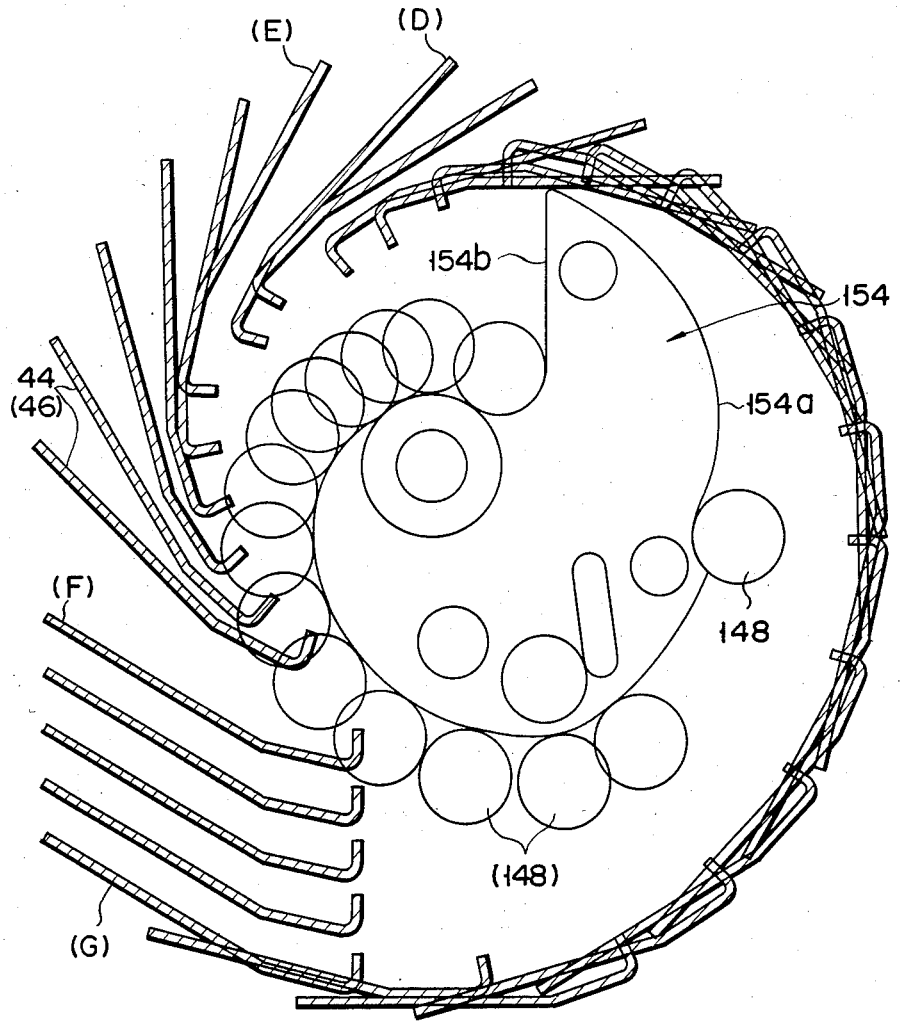

As shown in FIG. 6, the cam 154 has a first guide surface 154*a* having shape of a volute line concentric with the vane wheels 30 and 32, and a straight second guide surface 154*b* connecting the starting point and terminal point of the first guide surface 154*a*. When the th rotating body 106 rotates, the moving member 128 reciprocates in accordance with the variation of the distance between the guide surface of the cam 154 and the center of rotation thereof. Thus, separators 44 and 46, attached to the pair of moving members 86 reciprocating in association with the moving member 128, shift their positions, describing the locus shown in FIG. 6.

Figure 7:
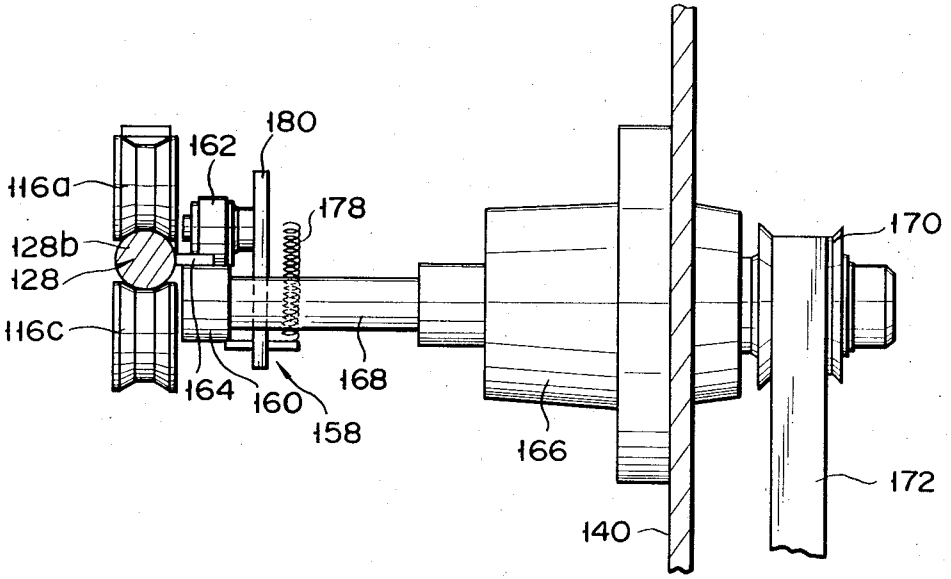

The separator operating mechanism 48 with the construction described above is also provided with a moving speed regulating mechanism 158, which adjusts the moving speed of the separator 44 and 46 in the paper sheet collecting direction in the collecting chamber 42, at the time of paper sheet distribution, to the guiding speed of the vane wheels 30 and 32, thereby preventing the separators 44 and 46 from suddenly coming down to strike and damage the paper sheets P previously collected in the collecting chamber 42. As shown in FIGS. 5 and 7, the moving speed regulating mechanism 158 includes a driving roller 160 as a rotating member rotating in proportion to the rotation of the vane wheels, a pinch roller 162 in rolling contact with the driving roller 160, and a brake plate 164 protruding integrally from the moving member 128 and interposed between the driving roller 160 and the pinch roller 162. The driving roller 160 is mounted on a rotating shaft 168 which is rotatably supported on the frame 140 by means or a bearing 166. A pulley 170 attached to one end of the rotating shaft 168, a belt 172, and a pulley 174 constitute a power transmission system 176. The power transmission system 176 associates the moving speed regulating mechanism 158 with the rotating shaft 70, which forms part of the power transmission system 78 for transmitting the driving force of the motor 80 to the vane wheels 30 and 32. The pinch roller 162 is attached to the free end of an arm 180 which is always urged by a spring 178 to be pressed against the driving roller 160.

Figure 8:
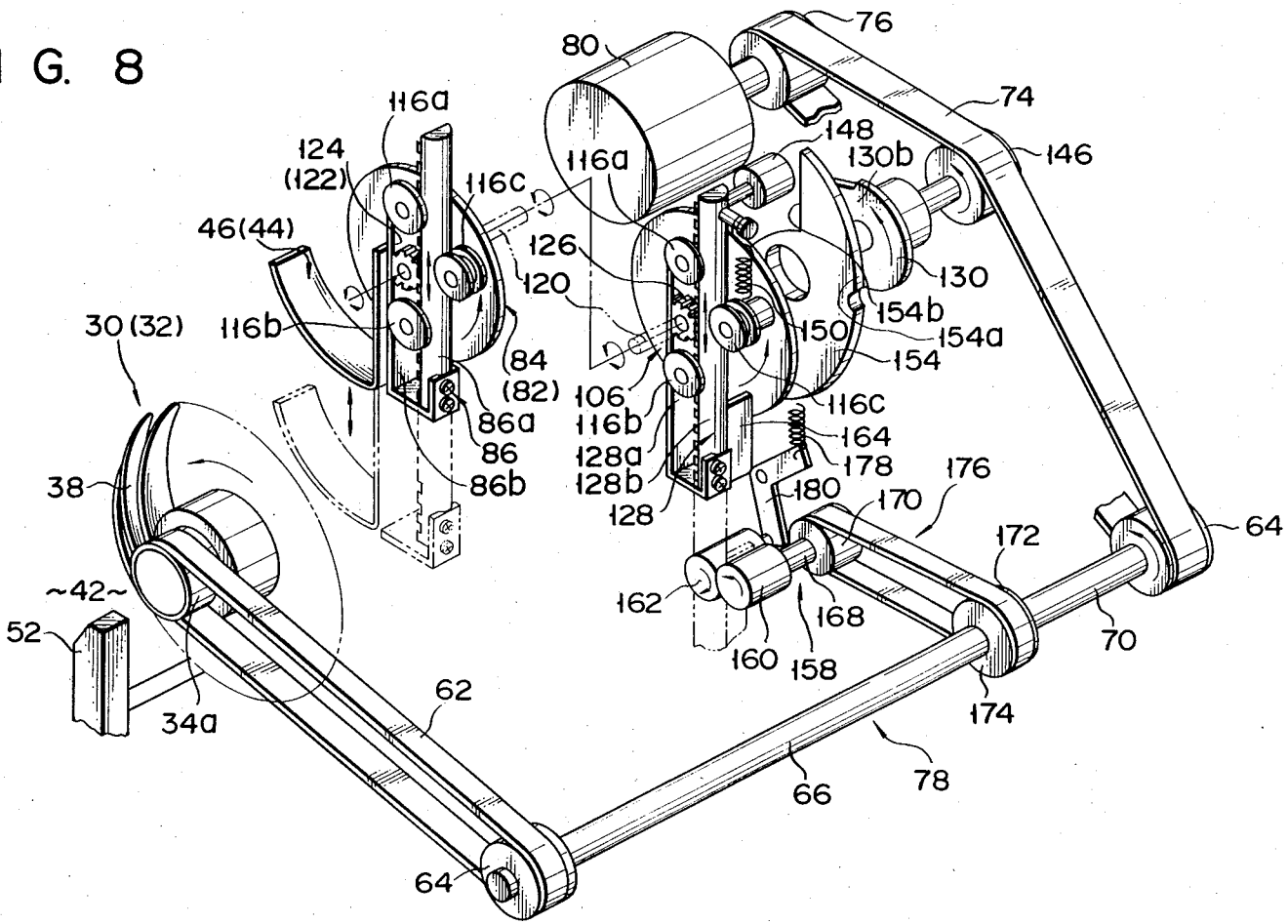

FIG. 8 is a perspective view schematically showing the configuration of the collecting apparatus described above.

The operation of the collecting apparatus with the above construction will now be described.

First, paper sheets P successively fed one by one along the conveying path 40 are guided, clamped between a pair of guide belts 182*a* and 182*b* defining the conveying path 40, as shown in FIG. 2. Then, the paper sheets P are transferred from the conveying path 40 to the vane wheels 30 and 32, which are rotating in the direction of arrow X at a peripheral speed about half the transfer speed of the conveying path 40.

The paper sheets P fed in this manner are inserted between the adjoining vanes 38 of the vane wheels 30 and 32. The paper sheets P thus inserted are held so that their forward end portions are caught between the vanes 38 and vane wheel frames 36. Thus, as the vane wheels 30 and 32 rotate, the paper sheets P are guided to the collecting chamber 42. Then, they are stroked by the second guide 52 to be dropped from the vane wheels 30 and 32 into the collecting chamber 42. Thus, the paper sheets P are collected one after another into the collecting chamber 42.

At this point of time, the separators 44 and 46 are in the stand-by position indicated by solid line in FIG. 2.

This position is maintained until the paper sheets P fed from the conveying path 40 count up to a predetermined number, e.g., 100.

When 100 paper sheets P are counted, the electromagnet 138 of the clutch mechanism 104 is actuated to cause the stopper 136 to be disengaged from the first retaining portion 130*a*. As a result, the rotary unit 114 starts rotate, so that the separators 44 and 46 start to move, describing loci (see FIG. 6) similar to those of the vanes 38 of the vane wheels 30 and 32. Accordingly, the distal end portions of the separators 44 and 46 pass by the outlet of the conveying path 40 before a 101st paper sheet P its discharged from the conveying path 40.

The separators 44 and 46 rock from a position D through a position E to a position F, as shown in FIGS. 2 and 6. Thereafter, the cam follower 148 of the separator operating mechanism 48 reaches the straight second guide surface 154*b* of the cam 154. As a result, the separators 44 and 46 are moved from the position F to a position G. As the separators 44 and 46 are moved in this manner, the 101st paper sheet P and its followers are temporarily collected on the separators 44 and 46. Hereupon, as mentioned before, the moving speed regulating mechanism 158 enables the separators 44 and 46 to descend at a speed matching the guiding speed of the vane wheels 30 and 32, thereby preventing the separators 44 and 46 from damaging the previously collected paper sheets P.

The separators 44 and 46 have substantially the same shape as the individual vanes 38 of the vane wheels 30 and 32. Therefore, the separators 44 and 46 can move from the stand-by position D to the position E beyond the outlet of the conveying path 40 in a very short time. Thus, the paper sheets P can securely be collected on the separators 44 and 46 even though the transfer pitch for the paper sheets P on the conveying path 40 is made considerably shorter than that for the prior art apparatus.

While the succeeding paper sheets P are being collected on the separators 44 and 46, the 100 paper sheets P previously collected on the receiving plate 54 in the collecting chamber 42 are delivered to the discharge mechanism (not shown) as the movable block 56 moves.

When the paper sheets P on the receiving plate 54 are discharged, the receiving plate 54 rises up to a predetermined position to form the bottom of the collecting chamber 42. As the receiving plate 54 rises in this manner, the electromagnet 138 of the clutch mechanism 104 is actuated again to cause the stopper 136 to be disengaged from the second retaining portion 130*b*. As a result, the rotary unit 114 is rocked through 270°.

Accordingly, the separators 44 and 46 rock from the position G to the stand-by position D, as shown in FIGS. 2 and 6. As the separators 44 and 46 rock in this manner, the paper sheets P temporarily collected on the separators 44 and 46 are stroked by the second guide 52 to be dropped onto the receiving plate 54 in the collecting chamber 42. The separators 44 and 46 are held in the position D until another 100 paper sheets P are counted. This cycle of operation is repeated.

The present invention is not limited to the one embodiment described above. In the above embodiment, the moving members 86 are each formed of the rack 86*a* and the guide 86*b*, and the separators 30 and 32 are attached to their corresponding guides 86*b*. Alternatively, however, each moving member 86 may be formed of a rack only, and the separators 30 and 32 may be attached directly to their corresponding racks.

In the above embodiment, moreover, the moving speed regulating mechanism 158 includes the brake plate 164 which protrudes integrally from the moving member 128 and is interposed between the driving roller 160 and the pinch roller 162. Alternatively, however, the moving member 128 itself may be interposed between the rollers 160 and 162. The moving speed regulating mechanism 158 is not a requisite to the present invention, and the object of the invention may be achieved without the use of the mechanism 158.

Instead of being bank notes, the paper sheets may, for example, be printed matter, slips, postcards, etc.

It is to be understood that various changes and modifications may be effected in the present invention by one skilled in the art without departing from the scope or spirit of the invention.

What is claimed is:

1. A paper sheet for collecting appratus for collecting paper sheets successively fed from a conveying path into a collecting chamber, comprising:

a vane wheel rotatably disposed between the outlet of the conveying path and the inlet of the collecting chamber, said vane wheel including a drum-shaped frame and a plurality of vanes arranged on the outer peripheral surface of the frame along the circumference thereof;

first driving means for rotating the vane wheel on a fixed axis of rotation, whereby vane wheel holds each of the paper sheets from the conveying path between each two adjacent vanes thereof so that the paper sheets are guided into the collecting chamber as the vane wheel rotates;

separator means rotatable on the same axis of rotation of the vane wheel and movable in the radial direction of the vane wheel frame; and second driving means adapted to hold the separator means in a radially inward position off the outlet of the conveying path at the time of collection of the paper sheets and, to rock the separator means through a predetermined angle, thereby causing the separator means to pass by the outlet of the conveying path, and then to move the separator means radially outward so that the paper sheets can be collected on the separator means at the time of distribution of the paper sheets, said separator means including a rotating body rotating on the same axis of rotation of the vane wheel, a moving body attached to the rotating body so as to be able to reciprocate in the radial direction of the vane wheel, and at least one separator attached to the moving body, wherein said moving body is formed of a rack, and said separator means further includes a pinion gear rotatably attached to the rotating body and in mesh with the rack, said rack being supported for reciprocation through the engagement with the pinion gear, whereby the paper sheets are guided and collected into the collecting chamber by the vane wheel at the time of collection of the paper sheets, and the paper sheets fed from the conveying path are temporarily collected on the separator means by the vane wheel after the separator means passes by the outlet of the conveying path at the time of distribution of the paper sheets.

2. The paper sheet collecting apparatus according to claim 1, wherein each said vane has an end portion extending in the direction opposite to the rotating direction of the vane wheel.

3. The paper sheet collecting apparatus according to claim 2, wherein said separator means includes at least one separator having substantially the same shape as each said vane.

4. The paper sheet collecting apparatus according to claim 3, wherein said separator has an end located on the circumference of a circle substantially concentric with a circle described by the ends of the individual vanes.

5. The paper sheet collecting apparatus according to claim 4, wherein said separator extends so as to be located between the adjacent vanes.

6. A paper sheet collecting apparatus for collecting paper sheets successively fed from a conveying path into a chamber, comprising:

a vane wheel rotatably disposed between the outlet of the conveying path and the inlet of the collecting chamber, said vane wheel including a drum-shaped frame and a plurality of vanes arranged on the outer peripheral surface of the frame along the circumference thereof;

first driving means for rotating the vane wheel on a fixed axis of rotation, whereby the vane wheel holds each of the paper sheets from the conveying path between each two adjacent vanes thereof so that the paper sheets are guided into the collecting chamber as the vane wheel rotates;

separator means rotatable on the same axis of rotation of the vane wheel and movable in the radial direction of the vane wheel frame; and second driving means adapted to hold the separator means in a radially inward position off the outlet of the conveying path at the time of collection of the paper sheets and, to rock the separator means through a predetermined angle, thereby causing the separator means to pass by the outlet of the conveying path, and then to move separator means radially outward so that the paper sheets can be collected on the separator means at the time of distribution of the paper sheets, wherein said separator means include a rotating body rotating on the same axis of rotation of the vane wheel, a moving body attached to the rotating body so as to be able to reciprocate in the radial direction of the vane wheel, and at least one separator attached to the moving body, and wherein said second driving means includes a drive source, a cam member having a guide surface and driven by the drive source, a cam follower attached to the moving body and in rolling contact with the guide surface of the cam mmeber, and an urging member for urging the moving body so that the cam follower is always in rolling contact with the guide surface, and said separator is reciprocated in the radial direction of the vane wheel by the driving force in accordance with the variation of the distance between the guide surface of the cam member and the center of rotation thereof, whereby the paper sheets are guided and collected into the collecting chamber by the vane wheel at the time of collection of the paper sheets, and the paper sheets fed from the conveying path are temporarily collected on the separator means by the vane wheel after the separator means passes by the outlet of the conveying path at the time of distribution of the paper sheets.

7. The paper sheet collecting apparatus according to claim 6, wherein said guide surface includes a voluted first guide surface portion having the same center of rotation of the vane sheel, and a straight second guide surface portion connecting the starting point and terminal point of the first guide surface portion and extending in the radial direction of the vane wheel.

8. A paper sheet collecting apparatus for collecting paper sheets successively fed from a conveying path into a collecting chamber, comprising:

a vane wheel rotatably disposed between the outlet of the conveying path and the inlet of the chamber, said vane wheel including a drum-shaped frame and a plurality of vanes arranged on the outer peripheral surface of the frame along the circumference thereof;

first driving means for rotating the vane wheel on a fixed axis of rotation, whereby the vane wheel holds each of the paper sheets from the conveying path between each two adjacent vanes thereof so that the paper sheets are guided into the collecting chamber as the vane wheel rotates;

separator means rotatable on the same axis of rotation of the vane wheel and movable in radial direction of the vane wheel frame; and second driving means adapted to hold the separator means in a radially inward position off the outlet of the conveying path at the time of collection of paper sheets and, to rock the separator means through a predetermined angle, thereby causing the separator means to pass by the outlet of the conveying path, and then to move the separator means radially outward so that the paper sheets can be collected on the separator means at the time of distribution of the paper sheets, wherein said second driving means including moving speed regulating means for regulating the speed of movement of the separator means in the paper sheet collecting direction, and wherein said moving speed regulating means includes a pair of rotating members rotating in proportion to the rotation of the vane wheel and in rolling contact with each other, and a moving member interposed between the rotating members and attached integrally to the separator means, whereby the paper sheets are guided and collected into the collecting chamber by the vane wheel at the time of collection of the paper sheets, and the paper sheets fed from the conveying path are temporarily collected on the separator means by the vane wheel after the separator means passes by the outlet of the conveying path at the time of distribution of the paper sheets.

* * * * *